US006443725B1

(12) United States Patent
Kim

(10) Patent No.: US 6,443,725 B1
(45) **Date of Patent: *Sep. 3, 2002**

(54) APPARATUS FOR GENERATING ENERGY USING CYCLIC COMBUSTION OF BROWN GAS

(76) Inventor: Sang Nam Kim, Hyundai Apt. 202-104, 23-3 Chungdam-2dong, Kangnam-ku, Seoul (KR)

( * ) Notice: Subject to any disclaimer, the term of this patent is extended or adjusted under 35 U.S.C. 154(b) by 0 days.

This patent is subject to a terminal disclaimer.

(21) Appl. No.: 09/533,067

(22) Filed: Mar. 22, 2000

(30) Foreign Application Priority Data

Sep. 4, 1999 (KR) ..... 99-37519

(51) Int. Cl.[7] ..... F23C 6/04; F23C 11/00; F23D 14/16; F24C 15/24; A61H 33/06

(52) U.S. Cl. ..... 431/2; 431/7; 126/85 R; 126/91 R; 126/92 AC

(58) Field of Search ..... 431/5, 170, 1, 431/171, 202, 326, 4, 7, 2; 126/8, 91 R, 92 R, 85 R, 92 C, 92 AC; 204/266, 270, 271, 278

(56) References Cited

U.S. PATENT DOCUMENTS

| | | | | | |
|---|---|---|---|---|---|
| 558,176 | A | * | 4/1896 | Huber | 126/92 R |
| 951,060 | A | * | 3/1910 | Vanden Driessche | 126/85 R |
| 978,127 | A | * | 12/1910 | Brock | |
| 1,053,695 | A | * | 2/1913 | Ash | |
| 1,218,206 | A | * | 3/1917 | Panasevich | 126/85 R |
| 1,362,789 | A | * | 12/1920 | Hamilton | 126/92 C |
| 1,414,360 | A | * | 5/1922 | Hicks | 122/155.2 |
| 1,494,499 | A | * | 5/1924 | O'Dowd | 126/92 C |
| 1,502,200 | A | * | 7/1924 | Howlett et al. | 126/92 C |
| 1,784,927 | A | * | 12/1930 | Coon | 431/170 |
| 1,970,529 | A | * | 8/1934 | Walton | 431/170 |
| 1,978,517 | A | * | 10/1934 | Wetherbee | 431/170 |
| 2,093,239 | A | * | 9/1937 | Furlong | 431/170 |
| 2,098,629 | A | * | 11/1937 | Knowlton | |
| 3,262,872 | A | * | 7/1966 | Rhodes et al. | |
| 4,081,656 | A | * | 3/1978 | Brown | 431/11 |
| 4,465,455 | A | * | 8/1984 | Meyer | 431/78 |
| 4,828,481 | A | * | 5/1989 | Weil et al. | 431/7 |
| 5,244,558 | A | * | 9/1993 | Chiang | 204/241 |
| 5,279,260 | A | * | 1/1994 | Munady | |

FOREIGN PATENT DOCUMENTS

| | | | | |
|---|---|---|---|---|
| DE | 3838142 | * | 5/1990 | 431/2 |
| EP | 0101761 | * | 3/1984 | 431/2 |
| JP | 2000-329358 | * | 11/2000 | 126/91 R |
| JP | 200174216 | * | 3/2001 | |
| WO | WO-92/03686 | * | 3/1992 | 431/2 |

* cited by examiner

*Primary Examiner*—Carl D. Price

(57) ABSTRACT

An energy generating apparatus using the cyclic combustion of Brown gas is disclosed. The apparatus comprises a heat generating unit, an outer wall, a Brown gas generator, an open-shut valve and a burner. The heat generating unit is positioned on a base. The outer wall surrounds the heat generating unit so as to define a combustion chamber, is provided with a discharge hole at its upper portion, and radiates infrared rays. The Brown gas generator is used to generate Brown gas. The open-shut valve is positioned between supply pipes so as to block the Brown gas discharged from the Brown gas generator. The burner is used to heat the heat generating unit by burning Brown gas supplied through the open-shut valve and the supply pipes.

2 Claims, 3 Drawing Sheets

APPARATUS FOR GENERATING ENERGY USING CYCLIC COMBUSTION OF BROWN GAS

BACKGROUND OF THE INVENTION

1. Field of the Invention

The present invention relates, in general, to energy generating apparatuses using the cyclic combustion of Brown gas and, more particularly, to an energy generating apparatus using the cyclic combustion of Brown gas, which generates a great quantity of energy by allowing Brown gas to repeat a cycle wherein the Brown gas supplied to a sealed combustion chamber is evaporated and transformed into water molecules after combustion, the water molecules absorb infrared rays and far infrared rays radiated from a heat generating unit and infrared radiating material and are ionized into hydrogen and oxygen while being heated to a high temperature due to a self-heat generating phenomenon, and, thereafter, the ionized hydrogen and oxygen is burnt.

2. Description of the Prior Art

Generally, in order to generate energy by burning fossil fuel, a great quantity of air must be supplied to a combustion chamber and a great quantity of exhaust gas is discharged to the atmosphere. The amount of lost energy contained in the exhaust gas is about 60% or more of the total generated energy.

In researches into the field of electrolysis, no great progress has been made since Michael Faraday established the theory of electrolysis in 1833. That is, the method of electrolysis was established and well known, but the method of electrolysis has not been applied to boilers, heaters, heating furnaces, etc. for commercial use.

The fact that the method of electrolysis has not been utilized in commercial applications results from theoretical and technological deficiency. The theoretical deficiency is that the implosion and thermal reaction characteristics of the Brown gas have not been known. The technological deficiency is that there occur problems including the leakage of water from a torch tip, etc. while the electrolytic bath is operated continuously because the development of an electrolytic bath is not sufficient.

SUMMARY OF THE INVENTION

Accordingly, the present invention has been made keeping in mind the above problems occurring in the prior art, and an object of the present invention is to provide an energy generating apparatus using the cyclic combustion of Brown gas wherein a heat generating unit is heated to a temperature of 1,000° C. or more and an outer wall is heated by radiant heat radiated from the heat generating unit, so that infrared rays are radiated from the outer wall to the outside and inside.

Another object of the present invention is to provide an energy generating apparatus that generates a great quantity of energy by forcing Brown gas to repeat a cycle wherein the Brown gas supplied to the combustion chamber is evaporated and transformed into water molecules after combustion, the water molecules absorb infrared rays and far infrared rays radiated from the heat generating unit and infrared radiating material and are ionized into hydrogen and oxygen while being heated to a high temperature (1,000° C. →2,500° C. →4,000° C.) due to a self-heat generating phenomenon, and, thereafter, the ionized hydrogen and oxygen is burnt.

A further object of the present invention is to provide an energy generating apparatus that does not produce by-products, such as smoke, soot and odor.

Yet another object of the present invention is to provide an energy generation apparatus that does not need a chimney and an air supply.

In order to accomplish the above object, the present invention provides an energy generating apparatus using the cyclic combustion of Brown gas, comprising a heat generating unit positioned on a base, an outer wall surrounding the heat generating unit so as to define a combustion chamber, being provided with a discharge hole at its upper portion, and radiating infrared rays, a Brown gas generator for generating Brown gas, an open-shut valve positioned between supply pipes so as to block the Brown gas discharged from the Brown gas generator, and a burner for heating the heat generating unit by burning Brown gas supplied through the open-shut valve and the supply pipes.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Figure 1:
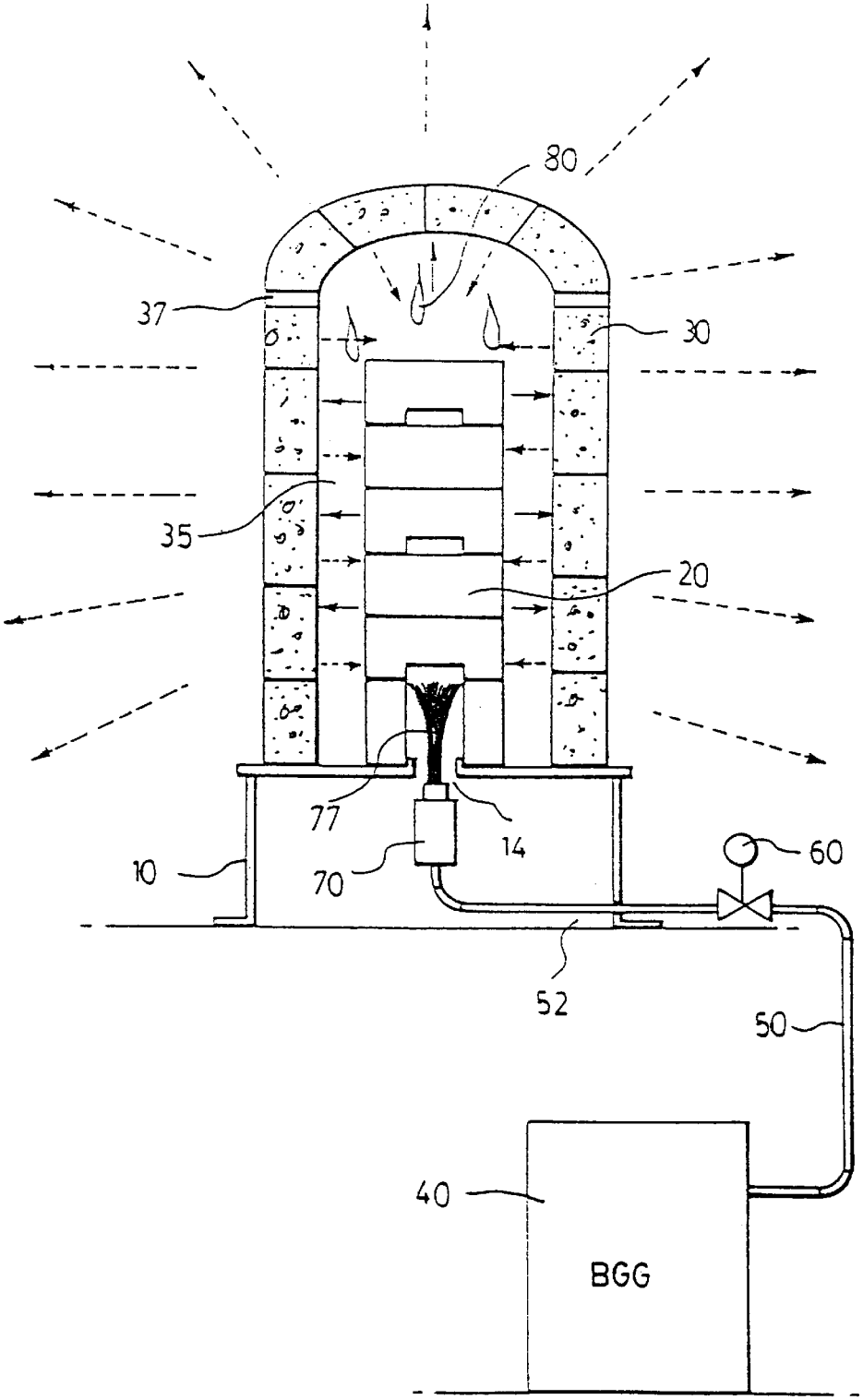
FIG. 1 is a partial cross section showing an energy generating apparatus using the cyclic combustion of Brown gas according to an embodiment of the present invention.
Figure 2:
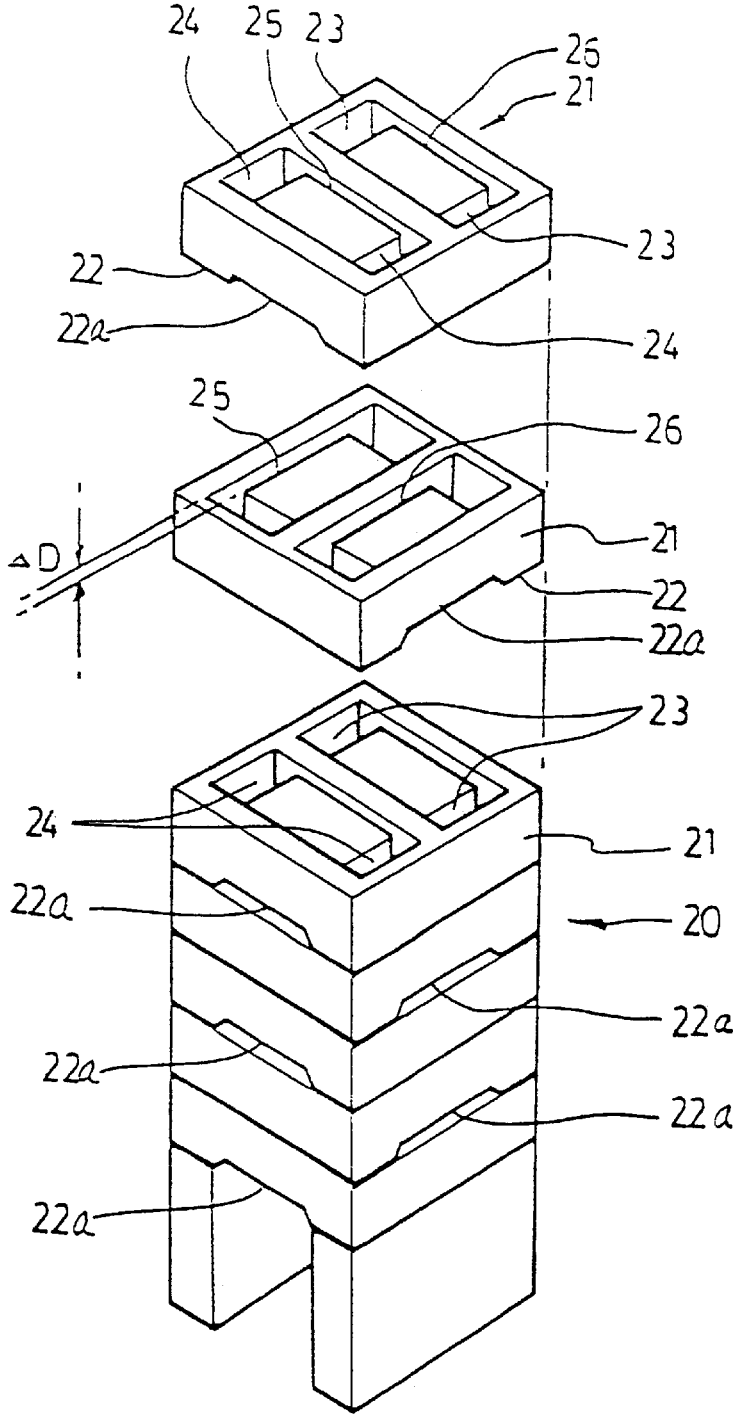
FIG. 2 is a detailed perspective view showing the heat generating unit of the apparatus of FIG. 1.

FIG. 1 is a partial cross section showing an energy generating apparatus using the cyclic combustion of Brown gas according to an embodiment of the present invention. FIG. 2 is a detailed perspective view showing the heat generating unit of the apparatus of FIG. 1.

As shown in FIGS. 1 and 2, an energy generating apparatus using the cyclic combustion of Brown gas according to an embodiment of the present invention comprises a heat generating unit 20 positioned on a base 10, an outer wall 30 surrounding the heat generating unit 20 so as to define a combustion chamber 35, being provided with a vapor discharge hole 37 at its upper portion, and radiating infrared rays, a Brown gas generator 40 for generating Brown gas, an open-shut valve 60 positioned between supply pipes 50 and 52 so as to block the Brown gas discharged from the Brown gas generator 40, and a burner 70 for heating the heat generating unit 20 by burning Brown gas supplied through the open-shut valve 60 and the supply pipes 50 and 52.

As illustrated in FIG. 1, the base 10 is made of iron members having a sufficient thickness and strength to sustain the heat generating unit 20 and the outer wall 30. The base 10 is preferably configured to have an internal cavity. The base 10 is provided at its top with a mounting hole 14 for holding and fixing the nozzle (not shown) of the burner 70 and is provided at its sidewall with a door (not shown) for maintaining and repairing the burner 70.

The heat generating unit 20 positioned on the base 10 is masoned by laying blocks 21 alternatively in regard to their directions, with each of the blocks 21 being made by calcining a block that is formed of high temperature ceramic (having a refractoriness of SK37 or more) whose chief ingredient is $Al_2O_3$. As shown in FIG. 2 in detail, each of the blocks 21 is provided with a groove 22*a*, two pairs of through holes 23 and 24 and a pair of depressions 25 and 26. The groove 22*a* is formed in the middle portion of the bottom of the block 21 so as to receive heat radiated from the flame 77 of the burner 20 and store the heat, the through holes 23 and 24 are formed through both sides of the groove 22*a* so as to transmit the stored heat upwards, and the depressions 25 and 26 are formed by depressing the top of the block 21 between two opposing through holes 23 or 24 by a depth of ΔD.

The infrared radiating material constituting the outer wall 30 should be a material that radiates a great quantity of infrared rays and is preferably elvan.

Hereinafter, the operation of an energy generating apparatus using the cyclic combustion of Brown gas is described.

The Brown gas in the present invention refers to a gas that is generated in the electrolytic structures of oxyhydrogen gas generators that are disclosed in Korea Utility Model Registration No. 117445, Korea Industrial Design Registration No. 193034, Korea Industrial Design Registration No. 193035, Korea Industrial Design Registration No. 19384266, Korea Industrial Design Registration No. 191184 and Japan Utility Model Registration No. 3037633.

The Brown gas is generated in the Brown gas generator 40, is supplied to the burner 70 through the open-shut valve 60 positioned between the supply pipes 50 and 52, and, subsequently, is spouted to the combustion chamber 35 through the nozzle of the burner 70.

At this time, if the Brown gas spouted from the nozzle of the burner 70 is ignited, the bottom block 21 of the heat generating unit 20 is heated as the gas flame 77 is generated. As a consequence, heat is transferred to the upper blocks 21 of the heat generating unit 20 through the holes 23 and 24, and so the heat generating unit 20 becomes red hot. Finally, the heat (whose directions are designated by the solid line arrows in FIG. 1) radiated from the heat generating unit 20 renders the outer wall 30 to be heated.

Since heat accumulated in the combustion chamber 35 is greater in amount than lost heat, the combustion chamber may be maintained to be at a high temperature with a small fuel supply. In addition, since the heat generating unit mounted in the combustion chamber 35 is directly heated by the Brown gas, the entire heat generating unit 20 is heated to be at a high temperature of 1,000° C. or more as the heat generating unit 20 becomes red hot due to the thermal reaction of the Brown gas.

The infrared rays (whose directions are designated by the long dotted line arrows in FIG. 1) radiated from the heated outer wall 30 to the outside may be used for the purpose of room heating because the outer wall 30 of the combustion chamber 35 is made of far infrared radiation material such as elvan and is sealed except for a vapor discharge hole 37.

Additionally, each of the infrared rays (whose directions are designated by the short dotted line arrows in FIG. 1) radiated from the outer wall 30 to the combustion chamber 35 is directed from a portion of the outer wall 20 to its opposing portion of the outer wall 20, and so each portion of the outer wall 20 heats its opposing portion of the outer wall 20, thereby heating the outer wall 20 to a high temperature. In addition, the heat generating unit 20 not only is heated by the combustion of the Brown gas but also is heated by the radiation of infrared rays from the outer wall 30.

As a consequence, the entire heat generating unit 20 radiates infrared rays continuously while being red hot at a temperature of 1,000° C. or more and at the same time the outer wall 30 radiates infrared rays continuously while being heated by the indirect heat of the heat generating unit 20, so that the temperature of the combustion chamber 35 is increased and is maintained high. As time passes, pillars of flames 80 are generated in the upper portion of the combustion chamber 35, that is over the heat generating unit 20. If the quantity of the Brown gas supply is not reduced, the exterior wall of the combustion chamber 35, that is the outer wall 30 may be melted down.

The operation of the present invention is described in more detail in the following.

1. Four Chief Characteristics of Brown Gas

A. Pollution-free Characteristic

Since the Brown gas is generated from water and is restored to vapor after being burned, pollutants are not created.

B. Complete Combustion Characteristic

Since the Brown gas is a mixture gas of hydrogen and oxygen that has a chemical equivalent ratio of two to one, the Brown gas has oxygen sufficient for complete combustion.

C. Implosion Characteristic

Figure 3:
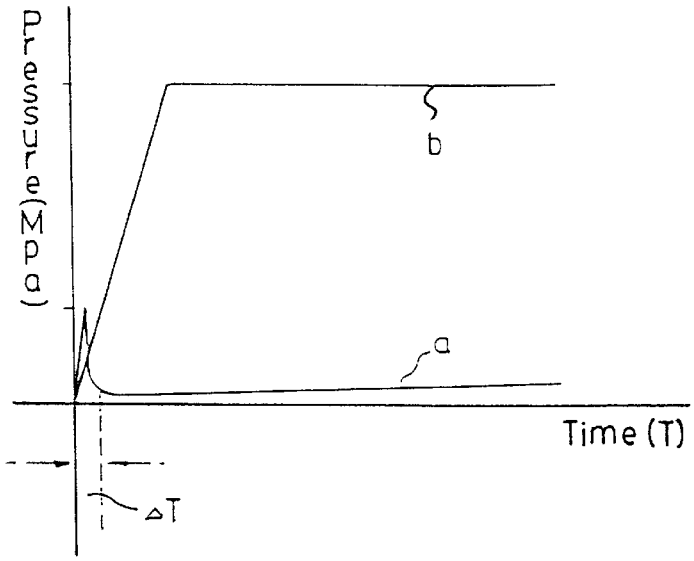
FIG. 3 is a graph showing the implosion characteristic of Brown gas.

The Brown gas generator 40 produces about 1,860 liters of Brown gas with 1 liter of water. On the contrary, as designated by curve "a" of FIG. 3, when 1,860 liters of the Brown gas is burnt in a sealed pressure container, a pressure of 0.5 MPa is reached and immediately an abrupt pressure drop is experienced, during the explosion duration ΔT of $^{44}/_{1,000,000}$ second. In addition, as soon as the pressure drop is experienced, implosion occurs and at the same time the volume reduction of $^{1}/_{1,860}$ is generated. That is, 1 liter of water is generated and the rest of the volume is vacuumized. The phenomenon may be referred to as implosion that is different from explosion. In FIG. 3, curve "b" is an explosion curve that is plotted when a normal gas is exploded in a pressure container, and is different from the curve "a".

The gas flame 77 occurring in the combustion of the Brown gas is generated by the continuation of implosions. The gas flame 77 progresses straight without interruption and forms a pinpoint flame. The length of the gas flame 77 may reach 400 mm.

D. Thermal Reaction Characteristic

The Brown gas is a mixture gas that includes atomic hydrogen and oxygen dissociated from water. In the gas flame 77 generated during the combustion of the Brown gas, the atomic and molecular hydrogen and oxygen reacts. The atoms of hydrogen and oxygen infiltrate into the atomic nucleus of heated material. The material that is heated by the thermal reaction of hydrogen and oxygen is heated by the gas flame 77 hotter than flame generated during the combustion of gas in the atmosphere. The Brown gas melts aluminum at 700° C. and evaporates tungsten while generating 6,000° C. of heat. The Brown gas that shows various thermal reactions according to heated materials can weld the blocks 21 to iron while melting the blocks 21 and the iron.

2. Combustion and Heat Generating Mechanism of Brown Gas

The combustion process of the molecular hydrogen and oxygen is as follows:

$H_2 \rightarrow H.+H.$ $O_2 \rightarrow O:+O:$ $H+O_2 \rightarrow O:+OH.$ $O:+H_2 \rightarrow H.+OH.$ $O:+H_2O \rightarrow OH.+OH.$ $OH.+OH. \rightarrow H_2O+O:$ When the electron of OH. is excited and is returned to its original state, heat is generated. Additionally, energy generated when atoms are transformed into molecules may be utilized.

3. Self-heat Generation Phenomenon by Infrared Rays

Figure 4:
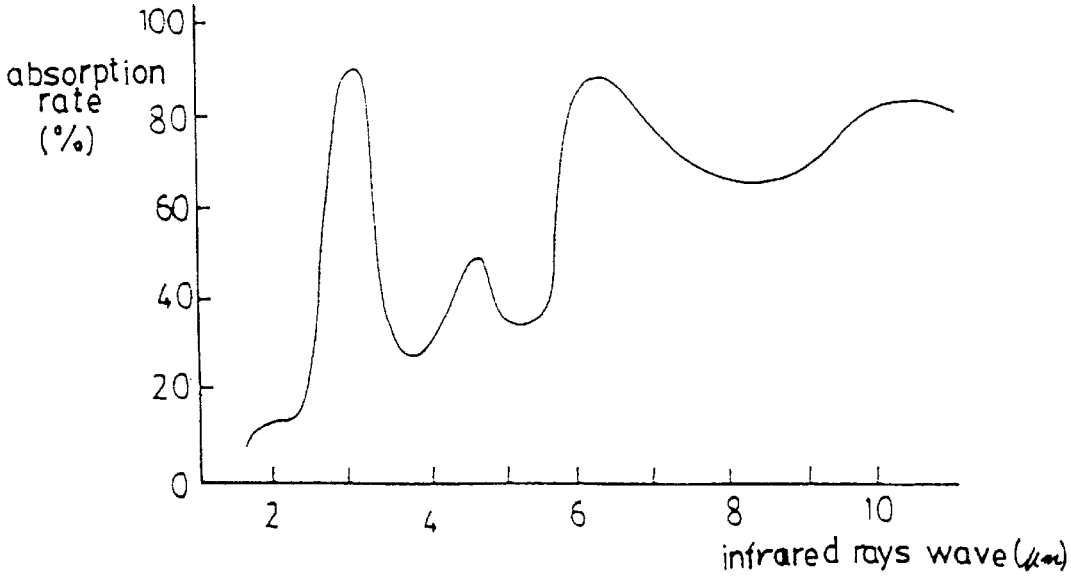
FIG. 4 is a graph showing infrared ray absorption ratios of water.

FIG. 4 is a graph showing infrared ray absorption ratios of water. The graph shows that the absorption ratio peaks at 3 $\mu$m of a middle-infrared wavelength range and the absorption ratios are high at 6–11 $\mu$m of far infrared wavelength range. In other words, if a molecule of water comes into contact with an infrared ray of 3 $\mu$m of a wavelength, the molecule absorbs almost 100% of the infrared ray. At this time, the molecule of water radiates a great quantity of energy as heat while the molecule of water is excited and the collisions of molecules of water become severe.

The energy generating apparatus of the present invention generates a great quantity of energy in the process of allowing the Brown gas to repeat a cycle wherein the water molecules generated continuously during combustion absorb infrared rays and far infrared rays and are ionized into hydrogen and oxygen while being heated to a high temperature due to a self-heat generating phenomenon and the ionized hydrogen and oxygen is burnt.

4. Function of Seal-type Combustion Chamber

In the energy generating apparatus using the cyclic combustion of Brown gas according to the present invention, the four chief characteristics of the Brown gas appear. In the apparatus, smoke and soot are not produced because carbon does not exist in the Brown gas, and the combustion in a sealed space in which an air inlet and a chimney are not needed is possible because complete combustion can be performed.

Therefore, since heat accumulated in the combustion chamber 35 is greater in amount than lost heat, the combustion chamber may be maintained to be at a high temperature with a small fuel supply.

In addition, since the heat generating unit mounted in the combustion chamber 35 is directly heated by the Brown gas, the heat generating unit 20 radiates heat as the heat generating unit 20 becomes red hot due to the thermal reaction characteristics of the Brown gas and the entire heat generating unit 20 is heated to be at a high temperature of 1,000° C. or more.

Since the outer wall 30 of the combustion chamber 35 is made of far infrared radiation material such as elvan and is sealed except for the vapor discharge hole 37, the infrared rays (whose directions are designated by the long dotted line arrows in FIG. 1) radiated from the heated outer wall 30 to the outside may be used for the purpose of room heating.

Additionally, each of the infrared rays (whose directions are designated by the short dotted line arrows in FIG. 1) radiated from the outer wall 30 to the combustion chamber 35 is directed from a portion of the outer wall 20 to its opposing portion of the outer wall 20, and so each portion of the outer wall 20 heats its opposing portion of the outer wall 20, thereby heating the outer wall 20 to a high temperature. In addition, the heat generating unit 20 not only is heated by the combustion of the Brown gas but also is heated by the radiation of infrared rays from the outer wall 30.

As a consequence, the entire heat generating unit 20 radiates infrared rays continuously while being red hot at a temperature of 1,000° C. or more and at the same time the outer wall 30 radiates infrared rays continuously while being heated by the indirect heat of the heat generating unit 20, so that the temperature of the combustion chamber 35 is increased and is maintained high. As time passes, pillars of flames 80 are generated in the upper portion of the combustion chamber 35, that is over the heat generating unit 20. The pillars of flames 80 prove that the vapor generated by the combustion of the Brown gas is burned cyclically.

The present invention generates energy at a high efficiency in the combustion chamber that has a sealed structure in which the interior temperature of the structure can be maintained at a high temperature with a small quantity of fuel, using as fuel the Brown gas having the above-described characteristics.

According to the present invention, the heat generating unit 20 is heated to a temperature of 1,000° C. or more by burning the Brown gas, and infrared rays are radiated from the outer wall 30 to the outside and inside by heating the outer wall 30 by means of radiant heat radiated from the heat generating unit 20. In addition, the Brown gas repeats a cycle wherein the Brown gas supplied to the combustion chamber 35 is evaporated and transformed into water molecules after combustion and the water molecules absorb infrared rays and far infrared rays radiated from the heat generating unit 20 and the infrared radiating material and are ionized into hydrogen and oxygen while being heated to a high temperature due to a self-heat generating phenomenon. In the process of repeating the cycle, since a great quantity of heat is generated by the cyclic combustion of the vapor and the Brown gas is burnt, air supply for the combustion and the chimney for discharging the by-products of the combustion are not needed.

According to the present invention, water can be used as fuel for commercial use because there is developed an electrolytic bath that generates the Brown gas stably, and the high barrier of an electrolytic technology can be broken down because the characteristics of the Brown gas are found and applied.

In addition, according to the present invention, there is provided the combustion chamber that does not need the air inlet and the chimney, using the characteristics of the Brown gas, thereby bringing about a combustion revolution. The energy generating apparatus can generate a great quantity of energy during the repetition of the cycle wherein the water molecules absorb infrared rays radiated from the infrared ray radiating material to the inside and are ionized into hydrogen and oxygen while being heated to a high temperature due to a self-heat generating phenomenon.

The present invention provides a new combustion technique that has not been fabricated by prior arts, thereby bringing about a combustion revolution. Since the heat generating apparatus of the present invention can achieve high temperature, the apparatus may be used as a combustion apparatus that should achieve high temperature.

For example, when a water conduit is positioned in the energy generating apparatus of the present invention and water is circulated through the water conduit, this construction may be used as a boiler. The energy generating apparatus may be used as a special waste disposal furnace that should reach 2,000° C.

Since the outside of the energy generating apparatus is formed of infrared radiating material such as elvan, a great quantity of far infrared rays of a wavelength range (6–14 $\mu$m) profitable to the human body is radiated when the heated temperature of the infrared generating material is maintained at 300–400° C. Therefore, the apparatus may be used for far infrared room heating for green houses, chicken raising houses and cattle sheds.

The inventor of the present invention has commercialized an elvan heating furnace that is an application of the energy generating apparatuses of the present invention. In the furnace, everybody can observe with an unaided eye a surprising phenomenon where the pillars of fire are generated while water is burnt.

The present invention may be applied to the elvan heating furnace that radiates far infrared rays of a wavelength range (6–14 $\mu$m) profitable to the human body, thereby improving human health by means of its heat effects. The present invention generates clean energy without pollution at a high efficiency, thereby realizing the dream of energy generation without pollution.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. An energy generating apparatus using the cyclic combustion of Brown gas, comprising:

a heat generating unit positioned on a base, wherein said heat generating unit is masoned by stacking blocks adjacently perpendicular lengthwise, with each of the blocks being made by calcining a block of high temperature ceramic whose chief ingredient is $Al_2O_3$, in which each of the blocks is provided with a groove formed in a middle portion of a bottom of the block so as to improve the block's capacity to receive and store heat, two pairs of through holes formed through both sides of the groove so as to transmit the stored heat upwards, and a pair of depressions formed by depressing a top of the block between the two pairs of opposing through holes;

an outer wall surrounding the heat generating unit so as to define a combustion chamber, heated by the heat generating unit and radiating infrared rays and far infrared rays which have a combined wavelength comprising a range that is absorbed by water;

a Brown gas generator generating Brown gas; and a burner heating the heat generating unit by burning Brown gas supplied from the Brown gas generator.

2. An energy generating apparatus using the cyclic combustion of Brown gas, comprising:

a heat generating unit masoned by stacking blocks adjacently perpendicular lengthwise, with each of the blocks being made by calcining a block of high temperature ceramic whose chief ingredient is $Al_2O_3$, and being provided with a groove formed in a middle portion of a bottom of the block so as to improve the block's capacity to receive and store heat, two pairs of through holes formed through both sides of the groove so as to transmit the stored heat upwards, and a pair of depressions formed by depressing a top of the block between the two pairs of opposing through holes;

an outer wall surrounding the heat generating unit so as to define a combustion chamber, heated by the heating unit, and radiating infrared rays;

a Brown gas generator generating Brown gas; and a burner heating the heat generating unit by burning Brown gas supplied from the Brown gas generator.

* * * * *